United States Patent [19]

Bonfilio

[11] 4,098,281

[45] Jul. 4, 1978

[54] COLLAPSIBLE SHELTER

[76] Inventor: Paul Bonfilio, 47-25 198th St., Flushing, N.Y. 11358

[21] Appl. No.: 783,250

[22] Filed: Mar. 31, 1977

[51] Int. Cl.[2] ..... A45F 1/16; E04F 10/04

[52] U.S. Cl. ..... 135/4 R; 135/5 R; 135/7.1 R

[58] Field of Search ..... 135/DIG. 1, 4 R, 5 R, 135/7.1 R

[56] References Cited

U.S. PATENT DOCUMENTS

| | | | |
|---|---|---|---|
| 720,709 | 2/1903 | Lawrenz | 135/5 R |
| 1,126,236 | 1/1915 | Lees | 135/DIG. 1 |
| 2,006,655 | 7/1935 | Roth | 135/7.1 R |
| 2,266,853 | 12/1941 | Dabney | 135/5 R |
| 2,689,579 | 9/1954 | Sartori | 135/4 R |
| 2,910,078 | 10/1959 | Schunck | 135/DIG. 1 X |
| 3,042,053 | 7/1962 | Gabriel | 135/4 R |
| 3,190,300 | 6/1965 | Wear'n | 135/4 R X |
| 3,386,456 | 6/1968 | Walker | 135/DIG. 1 X |
| 3,874,398 | 4/1975 | Hendrickson | 135/4 R |

FOREIGN PATENT DOCUMENTS

| | | | |
|---|---|---|---|
| 17,517 of | 1906 | United Kingdom | 135/DIG. 1 |

*Primary Examiner*—Werner H. Schroeder
*Assistant Examiner*—Conrad L. Berman
*Attorney, Agent, or Firm*—Allison C. Collard

[57] ABSTRACT

A collapsible shelter includes a central hub, a multiplicity of ribs, pivotably secured and extending radially outwardly from the hub, and a covering material secured to each of the ribs and interconnecting adjacent ones thereof. The ribs of the shelter are movable between an open position in which they are spread apart in a fan-shaped pattern and a closed, collapsed position in which the ribs are disposed closely adjacent one another. The shelter also includes locking means for releasably securing the ribs in an open position. The shelter is especially suitable for use on the beach, swimming pool decks, terraces, and the like.

9 Claims, 14 Drawing Figures

12
14
23'
33
34
35
36
37
38
137
18'

14
16
17
31
33

31
35
38

13
14
16
23'
31
33

10
11
13
14
15
16
18'
26'
29
31
32
34
35
36
37

COLLAPSIBLE SHELTER

BACKGROUND OF THE INVENTION

This invention relates to a collapsible shelter and, more particularly, to a collapsible shell which is especially suitable for use on the beach, swimming pool decks, terraces, and the like.

Collapsible shelters, such as beach umbrellas, and the like, used to provide protection against the sun at beaches and other recreational areas are, of course, well known in the art. However, these prior art structures have tended to have certain drawbacks. Some do not afford adequate sun and wind protection. Others do not provide sufficient privacy. Moreover, shelters of the roll-bar type, which open in a manner similar to a buggy top, are cumbersome to carry, quite heavy and relatively difficult to set up.

While attempts have been made to improve upon the above-noted deficiencies, so far as is known, no presently available collapsible shelter affords the advantages of that of the present invention, nor deals with these problems in a relatively simple and effective manner.

Accordingly, it is an object of the present invention to provide a novel collapsible shelter which affords privacy and protection against the wind and sun.

It is also an object of the present invention to provide such a shelter which is lightweight, portable and easy to install.

It is a further object of this invention to provide such a shelter which is of relatively simple design, inexpensive, durable and reliable in operation.

It is a more particular object of this invention to provide a novel shelter having the foregoing attributes and characteristics which is especially suitable for use on the beach, swimming pool decks, terraces, and the like.

SUMMARY OF THE INVENTION

It has now been found that certain of the foregoing and related objects are readily attained in a collapsible shelter which includes a central hub and a multiplicity of ribs radially spaced about at least a portion of the hub and extending radially outwardly therefrom. Each of the ribs has an outer end and an inner end, the inner end of which is pivotably mounted on the hub to permit movement of the ribs between an open position, in which the outer ends of the ribs are moved laterally away from one another, and a collapsed, closed position, in which the outer ends of the ribs are disposed closely adjacent one another. The shelter also includes a cover material secured to each of the ribs and interconnecting adjacent ones thereof, and locking means for releasably securing the ribs in the open position.

Preferably, the ribs have an arcuate configuration and the shelter additionally includes means for anchoring the shelter to a support. Most advantageously, the ribs comprise cylindrical, hollow rods and the cover material comprises a fabric material.

Most advantageously, the central hub has a multiplicity of radially-spaced holes formed therein adjacent its curved periphery, and the inner ends of the ribs are pivotably received therein. Most desirably, the central hub includes a handle, and the ribs and rods are fabricated from aluminum.

In one preferred embodiment, the locking means comprise a plurality of locking assemblies, each of which is disposed between a pair of adjacent ribs and includes a pair of elongated rods, pivotably secured to one another intermediate the ends thereof. One of the rods has an inner end which is pivotably mounted to one of the pair of adjacent ribs and the other rod has an inner end, which is pivotably mounted to the other of the pair of adjacent ribs, to permit movement of the ribs between a locking position, in which the rods are disposed substantially perpendicular to the ribs, and a collapsed, closed position, in which the rods are disposed substantially parallel to the ribs. Each of the rods has an outer end which is configured for releasable, locking engagement with a portion of the other rod so that, upon pivoting of the outer ends of the rods about their inner ends, the outer ends of the rods will releasably engage a portion of the other rod to thereby maintain the shelter in the open position. Most desirably, the outer ends of the rods have formed thereon an upwardly-opening, generally U-shaped flange which is dimensioned for frictional engagement with the portion of the other rod.

In another embodiment, the locking means comprise at least one locking assembly, including a pair of elongated rods, each having an outer and an inner end. Each of the rods is pivotably secured at its inner end to one of the outermost ribs to permit pivotal movement thereof, between a collapsed position, in which the rods lie generally closely adjacent and parallel to the outermost ribs, and a locking position, in which one of the rods transversely spans several of the inwardly-disposed ribs and the other of the rods, transversely spans the remaining inwardly-diposed ribs. Means are also provided for demountably securing the rods to the respective ribs which they span. The assembly further includes a pair of elongated bars which are pivotably joined together at their inner ends, each of which has an outer end which is pivotably secured to the other end of one of the rods. Most advantageously, these rods have a generally arcuately-shaped configuration, and one of the bars has a knob mounted thereon adjacent to its inner end.

DETAILED DESCRIPTION OF THE ILLUSTRATED EMBODIMENT

Figure 9:
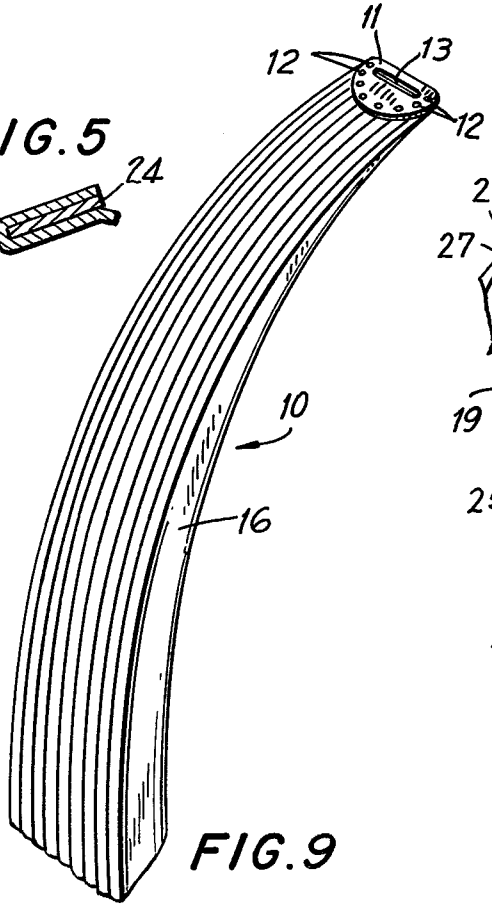
FIG. 9 is a perspective view of the shelter in a fully-collapsed, closed position.
Figure 8:
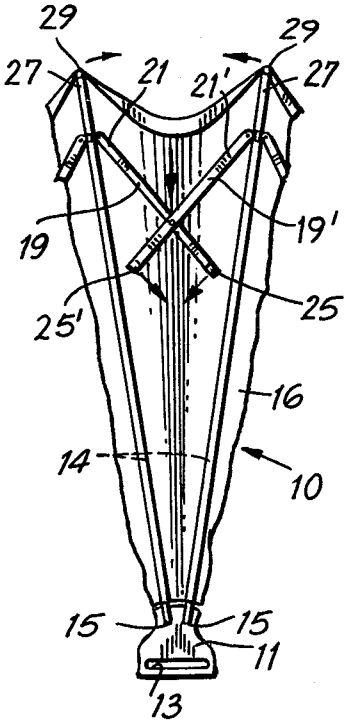
FIG. 8 is a fragmentarily-illustrated, front elevational view of the shelter, shown in a partially-collapsed position.
Figure 5:
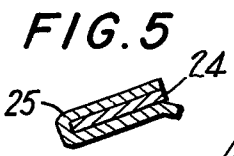
FIG. 5 is an enlarged, cross-sectional view taken along line 5—5 of FIG. 3.
Figure 6:
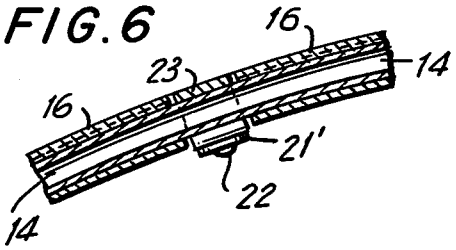
FIG. 6 is an enlarged, cross-sectional view taken along line 6—6 of FIG. 2.

Turning now in detail to the appended drawings, therein illustrated is a novel collapsible beach shell or shelter, embodying the present invention, generally designated by the numeral 10. As seen more clearly in FIGS. 2, 8 and 9, the shell includes a generally semi-circular, flat central hub 11 which has formed therein, adjacent its curved periphery, eight radially and equidistantly spaced holes 12 and, adjacent the rectilinear portion of its periphery, an elongated slot 13, which serves as a handle for carrying the shell 10.

Eight generally arcuately-shaped, hollow, cylindrical ribs 14 extend radially outwardly from the hub 11, and each has an inner end portion 15, which is pivotably received within one of the holes 12 of the hub. As a result of this pivotable mounting, the ribs 14 may be moved between an open position (FIGS. 1 and 2), in which the outer ends 29 of the ribs 14 are moved laterally away from one another to effect a curved, fan-shaped pattern, and a closed, collapsed position (FIG. 9), in which the outer ends 29 of the ribs 14 are disposed closely adjacent one another.

Figure 7:
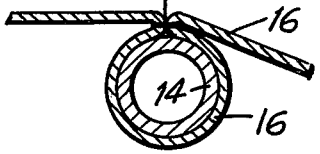
FIG. 7 is an enlarged, cross-sectional view taken along line 7—7 of FIG. 2.

A suitable covering material 16, such as a fabric material, is draped over the ribs 14 and is drawn or wrapped around each one and fastened thereto in a suitable manner, such as by clasp 17 (FIG. 7). The covering material is of sufficient dimensions such that when the ribs 14 are moved to the open position, the covering material 16 is drawn taut. In FIGS. 1, 2, 3, 8, 10 and 11, ribs 14 are indicated by dotted lead lines due to the fact that they are normally enclosed by a fabric material 16 except where locking assemblies (which will be described in greater detail hereinbelow) are mounted thereon; this is more clearly illustrated in FIGS. 6, 7, 12 and 13.

A releasably locking assembly, generally designated by the numeral 18 is mounted between each pair of adjacent ribs 14. Each assembly 18 includes a pair of elongated, generally rectangular, flat rods 19, 19' which are pivotably secured to one another, intermediate the ends thereof, by means of a pin 20. The inner ends of each rod 21, 21' are pivotably secured, by means of a pin 22, to a bracket 23 mounted on each of the ribs 14. The outer ends 24, 24' of each of the rods 21, 21' have an upwardly opening U-shaped flange 25, 25', formed on their opposed lateral faces which, upon upward pivoting of the outer ends 24, 24' of the rods 19, 19', receive and releasably engage a portion of the other rod adjacent its inner end 21, 21'. The flanges 25, 25' are suitably dimensioned so as to provide a frictional interengagement between the flanges 25, 25' and the portions of the other rods received therein, so that, in such a locked position (wherein the rods 19, 19' assume a substantially perpendicular relationship with respect to the ribs 14), the rods 19, 19' cooperate to maintain the shell in its open position, while affording relative rigidity to the structure; the covering material 16, as a result of it being stretched when the shell is fully opened, also cooperates with the locking assemblies to enhance structural rigidity. The frictional fit is, of course, designed to afford ready disengagement of the rods 19, 19', so as to facilitate collapse of the structure.

Figure 3:
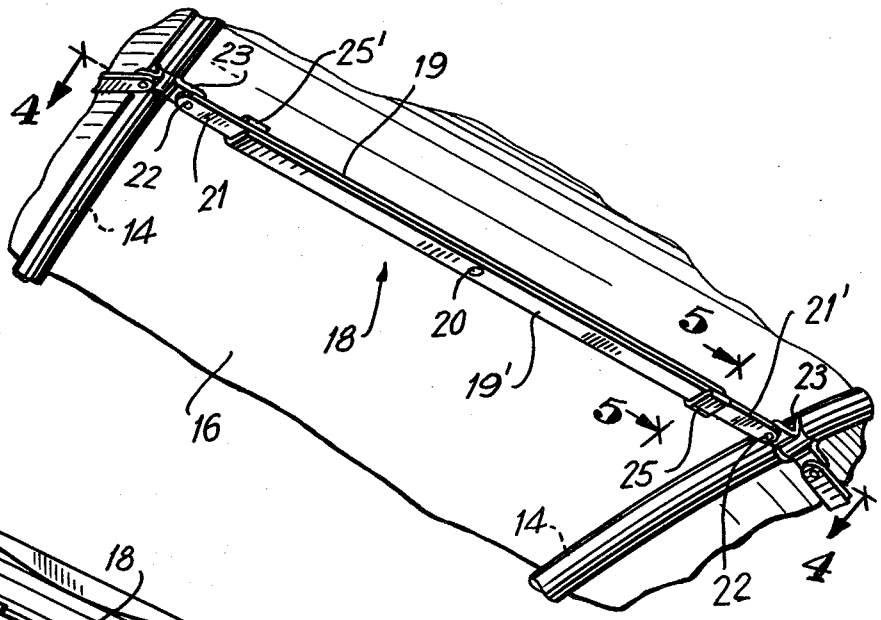
FIG. 3 is a fragmentarily-illustrated, perspective view of a portion of the shelter shown in FIG. 2, drawn to a further enlarged scale from that of FIGS. 1 and 2.
Figure 1:
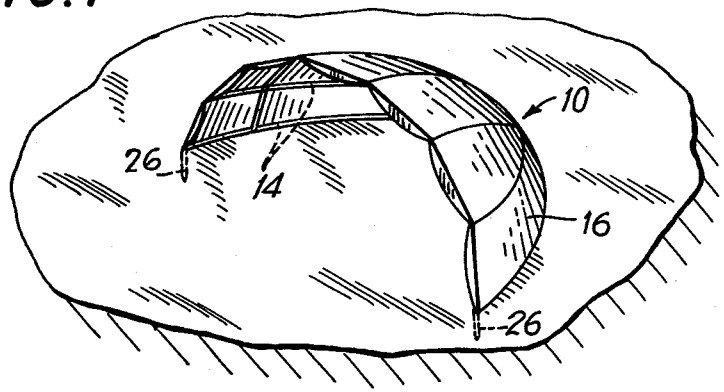
FIG. 1 is a perspective view of a novel collapsible shelter, embodying the present invention.
Figure 2:
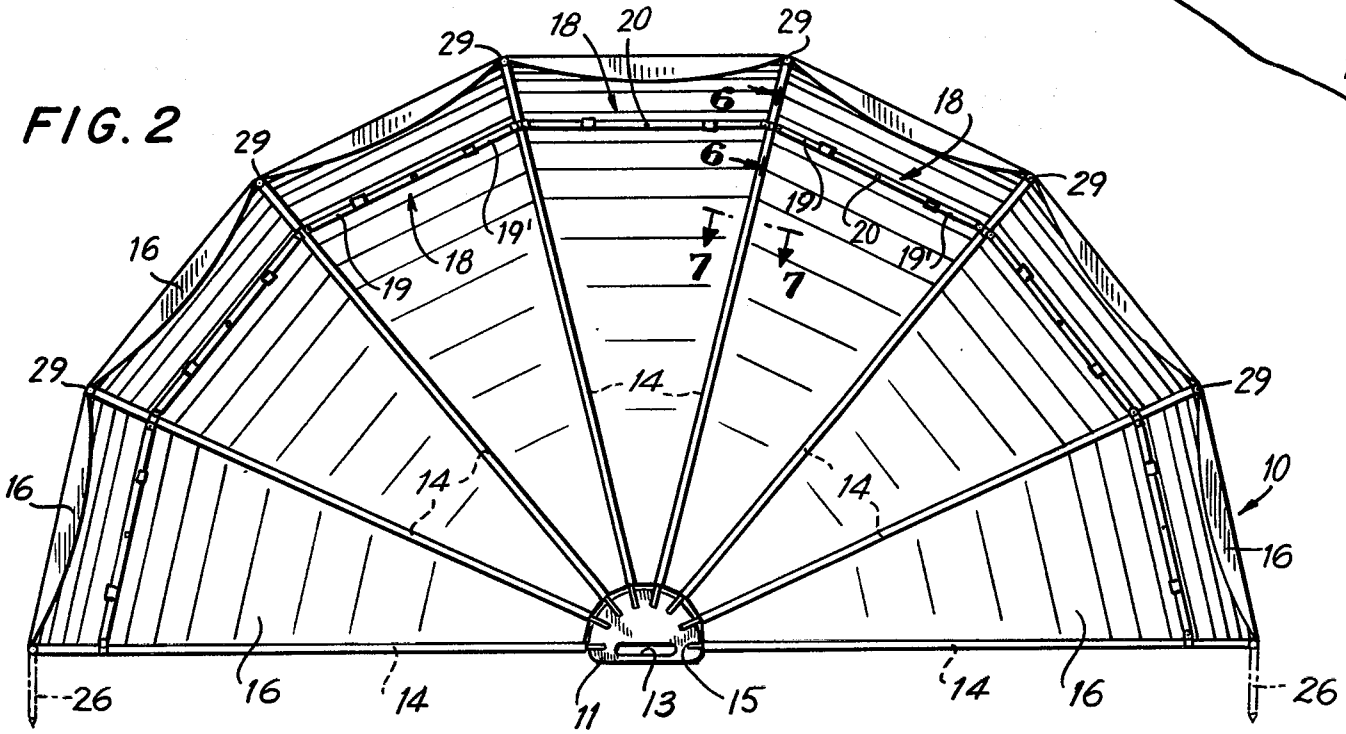
FIG. 2 is an enlarged, front elevational view of the shelter illustrated in FIG. 1.
Figure 4:
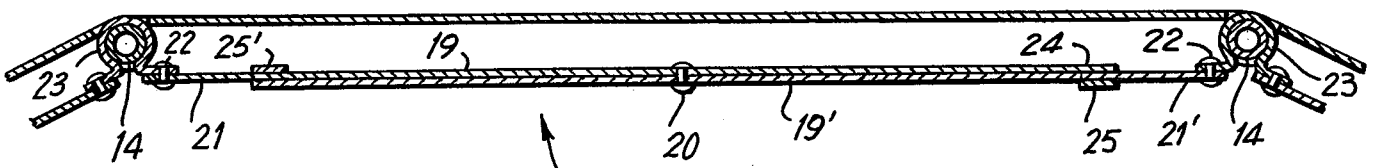
FIG. 4 is an enlarged, cross-sectional view taken along line 4—4 of FIG. 3.

Thus, to open the shell 10, the user simply spreads the ribs 14 apart in a fan-shaped pattern (the ribs pivoting about their inner ends 15), which, in turn, causes the outer ends 24, 24' of the rods 19, 19' to pivot upwardly about their inner ends 21, 21'. Consequently, as the outer ends 24, 24' of the rods 19, 19' are pivoted upwardly, their flanged portions 25, 25' will engage and receive a portion of the other rod, thereby locking the structure in its open position. The opened shell 10 may then be fastened to the ground by means of spikes 26 secured to the two outer ribs (FIGS. 1 and 2).

As can be appreciated, shade is provided simply by turning the shell's back to the sun, thereby casting a shadow within the shell as well as beyond, depending upon the sun's angle. The shell affords relative privacy by establishing a somewhat walled-in environment. One can also have some privacy while sunbathing simply by turning the open end of the shell into the sun. Wind protection is provided when the shell's back or side is directed towards the wind. Also, the shell affords protection against the possibility of having said kicked in one'face.

To collapse the shell 10, the user initially removes the spikes 26 and applies a downward force to the rods 19, 19', preferably adjacent their pivotal connection 20 to disengage their locked flanged portions 25, 25'. Then the ribs 14 may be easily pushed together (FIG. 8) to collapse the shell (FIG. 9); movement of the ribs 14 toward one another causing further downward pivoting of the outer ends 24, 24' of the rods until the rods 19, 19' assume a substantially parallel relationship with respect to the closely-packed ribs 14. Once closed, the end of the shell 10 opposite the hub 11 could then be tied together (not shown) to facilitate transport.

Figure 11:
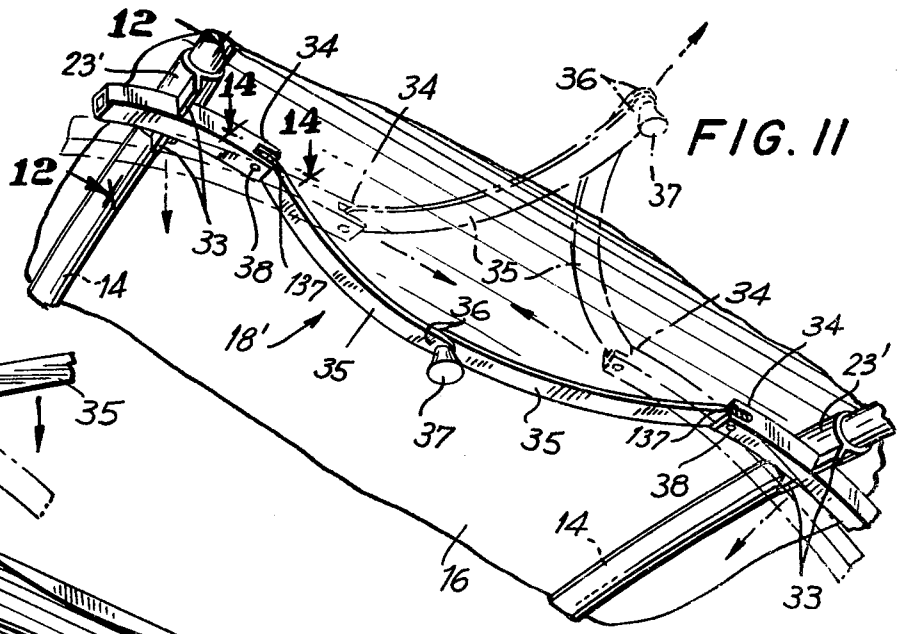
FIG. 11 is an enlarged, fragmentarily-illustrated perspective view of a portion of the shelter shown in FIG. 10, showing in full line the lock means in a locking position and, in phantom line, its movement to an unlocking position.
Figure 13:
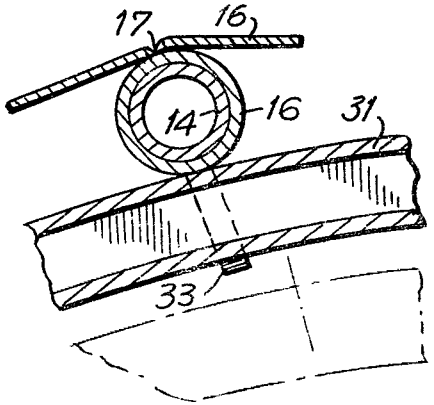
FIG. 13 is an enlarged, cross-sectional view taken along line 13—13 of FIG. 12.
Figure 14:
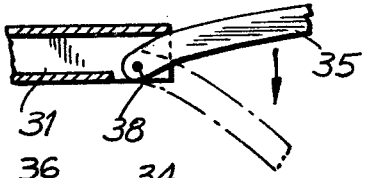
FIG. 14 is an enlarged, cross-sectional view, in part elevation, taken along line 14—14 of FIG. 11, showing the locking position of the locking means in full line and the unlocking position thereof in phantom line.
Figure 12:
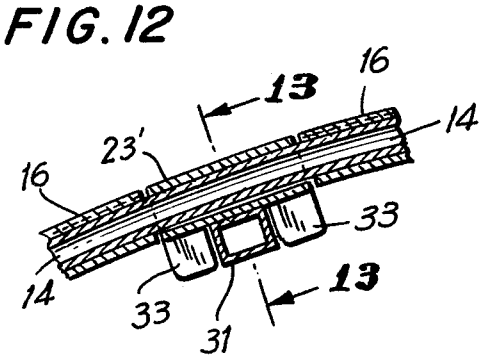
FIG. 12 is an enlarged, cross-sectional view, in part elevation, taken along line 12—12 of FIG. 11.
Figure 10:
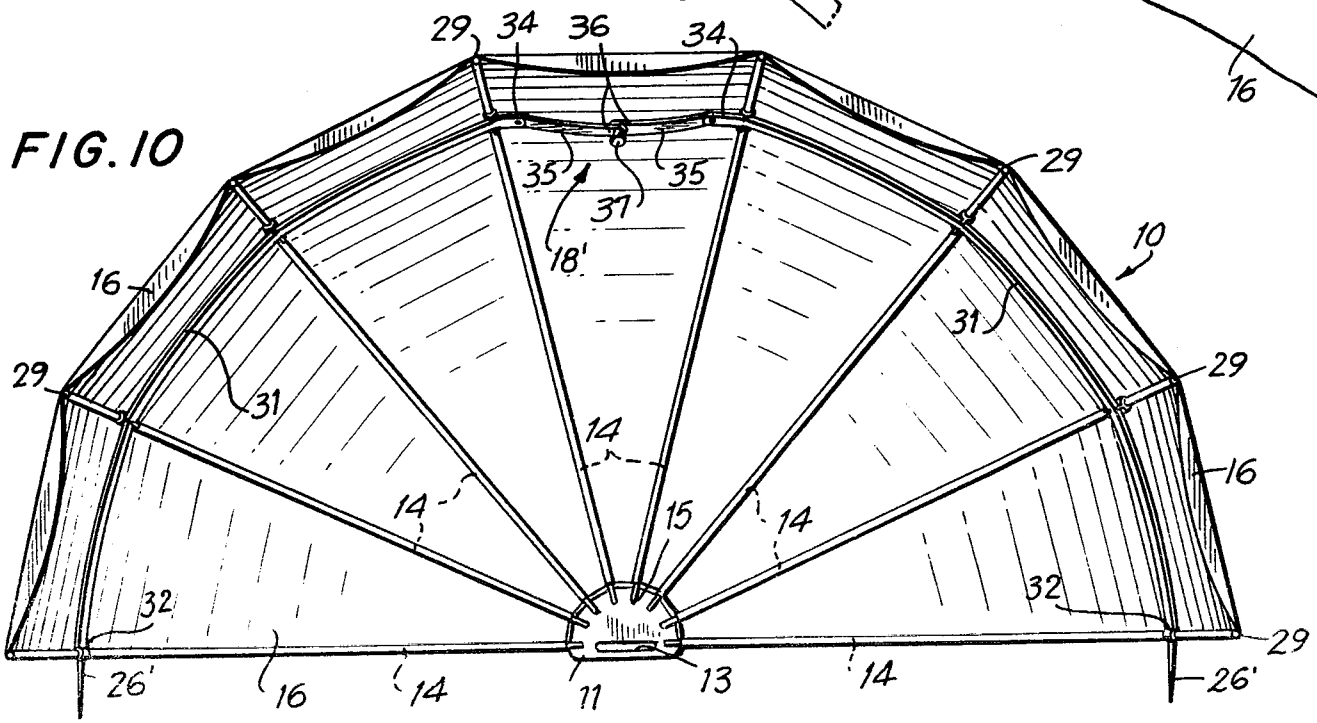
FIG. 10 is a front, elevational view of the shelter showing an alternate embodiment of the lock means used to maintain the shelter in an open position.

FIGS. 10–14 illustrate an alternate embodiment of the locking assemblies 18, shown in the foregoing FIGURES. As can be seen best in FIG. 10, the alternate locking assembly, generally designated by the numeral 18', includes two elongated, generally arcuately-shaped hollow rods 31, each of which has a generally square cross-section. The rods 31 each has an inner end 32, which is pivotably secured to one of the two outermost ribs 14, adjacent to its end 29, to permit pivotal movement of the rods 31 between a collapsed position, in which the rods lie closely adjacent and parallel to the outer ribs 14, and a locking position, in which each of the rods 31 transversely span half of the remaining inwardly-disposed ribs 14. As seen in FIGS. 11–13, in the latter position, the rods 31 are demountably secured to the inner ribs 14 by means of a generally cylindrical, hollow bracket 23', mounted on each of the inner ribs (adjacent to their outer ends 29), each of which has a pair of space-apart flanges 33, which cooperate to grasp the rod therebetween; the flanges 33 preferably providing a frictional coupling for the rods 31.

As seen more clearly in FIG. 11, the outer ends 34 of the rods 31 are coupled together by means of a pair of concavely-shaped bars 35, which are pivotably joined together at their inner ends 36, and one of which has a knob 37 attached thereto. The outer ends 137 of each of the bars 35 are pivotably secured, by means of a pin 38, to the outer ends 34 of one of the rods 31.

By a toggle-like movement of the bars 35, effected by a downward, vertical displacement of knob 37 (see FIG. 14), the bars 35 will assume a generally parallel relationship to one another and, in turn, will effect locking of the rods 31 in a relatively rigid, open position; the stretching of the covering material serving to maintain the bars 36 in a locked position and enhancing structure rigidity. Conversely, upward displacement of knob 37 (shown in phantom-line in FIG. 11), will cause upwardly pivoting of the bars 35 about their inner ends, in turn, causing unlocking of the rods 31, thus permitting collapse of the shell 10.

It should be pointed out that usually prior to effecting a locked position of bars 35, the rods 31 are first demountably secured between the flanges 33 of the brackets 23' and prior to unlocking, the rods 31 are first detached from these brackets 23'. It should also be noted that the inner ends of rods 31 may have spikes 26' afixed thereto, to secure the opened shell to the ground support.

While the instant invention has been described in relation to the illustrated and preferred embodiment, it should be understood that modifications may be made as will be apparent to those skilled in the art. For instance, the size, shape and number of ribs and locking assemblies employed may be varied. In addition, although the ribs, bars and rods are preferably fabricated from lightweight aluminum, other suitable materials may be employed. Finally, it may also be possible to provide for folding of the individual ribs after they have been collapsed, to provide a more compact and easily transported and stored construction.

Thus, it can be seen that the present invention provides a novel collapsible shelter which affords privacy and protection against the wind and sun, and which is lightweight, portable and easy to install. The shelter is of relatively simple design, inexpensive, durable and reliable in operation. In addition, the shelter is especially suitable for use at the beach, or swimming pool decks, terraces, and the like.

What is claimed is:

1. A collapsible shelter comprising:

a central hub;

a multiplicity of ribs radially spaced about at least a portion of said hub and extending radially outwardly therefrom, each of said ribs having an outer free end and an inner end, the inner end of which is pivotably mounted on said hub to permit movement of said ribs between an open position, in which the outer end of the ribs are moved laterally away from one another, and a collapsed, closed position in which the outer ends of said ribs are disposed closely adjacent one another;

a cover material secured to each of said ribs and interconnecting adjacent ones thereof; and locking means for releasably securing said ribs in said open position, said locking means comprising at least one locking assembly, including a pair of elongated rods, each having an outer and an inner end, and each of which is pivotably secured at its inner end to one of the outermost ribs to permit pivotal movement thereof, between a collapsed position, in which said rods lie generally closely adjacent, and parallel, to said outermost ribs, and a locking position, in which one of said rods transversely spans several of the inwardly-disposed ribs and the other of said rods transversely spans the remaining inwardly-disposed ribs, means for demountably securing said rods to the respective ribs which they span, and a pair of elongated bars which are pivotably joined together at their inner ends, said bars each having an outer end which is pivotably secured to the outer end of one of said rods.

2. The shelter of claim 1 wherein said ribs have an arcuate configuration.

3. The shelter of claim 1 wherein said shelter additionally comprises means for anchoring said shelter to a support.

4. The shelter of claim 1 wherein said ribs comprise cylindrical hollow rods.

5. The shelter of claim 1 wherein said cover material comprises a fabric material.

6. The shelter of claim 1 wherein said central hub has a generally semi-circular, flat configuration and has a multiplicity of radially-spaced holes formed therein adjacent its curved periphery and said inner ends of said ribs are pivotably received therein.

7. The shelter of claim 1 wherein said central hub includes a handle.

8. The shelter of claim 1 wherein said ribs and rods are fabricated from aluminum.

9. The shelter of claim 1, wherein said rods have a generally arcuately-shaped configuration and wherein one of said bars has a knob mounted thereon adjacent to its inner end.

* * * * *